US006155168A

United States Patent [19]

Sakamoto

[11] Patent Number: 6,155,168

[45] Date of Patent: Dec. 5, 2000

[54] INFORMATION RECORDING MEDIUM AND INFORMATION RECORDING METHOD SUITABLE FOR SECURITY PURPOSES

[75] Inventor: Masaki Sakamoto, Iwate-ken, Japan

[73] Assignee: Alps Electric Co., Ltd., Tokyo, Japan

[21] Appl. No.: 09/468,010

[22] Filed: Dec. 20, 1999

[30] Foreign Application Priority Data

Dec. 21, 1998 [JP] Japan ..... 10-362929

[51] Int. Cl.[7] ..... B41F 1/10

[52] U.S. Cl. ..... 101/171; 400/120.02

[58] Field of Search ..... 101/171; 400/120.02, 400/120.03, 120.04, 106

[56] References Cited

U.S. PATENT DOCUMENTS 5,210,068 5/1993 Egashira et al. ..... 503/227
5,759,727 6/1998 Malhotra ..... 430/97

FOREIGN PATENT DOCUMENTS 10-86539 4/1998 Japan .
10-154232 6/1998 Japan .

*Primary Examiner*—John S. Hilten
*Assistant Examiner*—Charles H. Nolan, Jr.
*Attorney, Agent, or Firm*—Brinks Hofer Gilson & Lione

[57] ABSTRACT

The present invention has an object to provide a information recording medium and an information recording method which permit confirmation of the same photo-portrait image as a photo-portrait image made with coloring ink by irradiating ultraviolet rays or infrared rays although the image cannot be confirmed within the visible region because the image is colorless and transparent within this region. The same photo-portrait image as the photo-portrait image is recorded with ultraviolet ink or infrared ink which emits fluorescence by irradiating ultraviolet rays or infrared rays on a portion other than the recording portion of the photo-portrait image made with the coloring ink on the surface of a substrate.

15 Claims, 2 Drawing Sheets

INFORMATION RECORDING MEDIUM AND INFORMATION RECORDING METHOD SUITABLE FOR SECURITY PURPOSES

BACKGROUND OF THE INVENTION

1. Field of the Invention

The present invention relates to an information recording medium with a photo and an information recording method. More particularly, the invention relates to an information recording medium recording personal identifying information such as a driver's license, an identification card, a passport, an ID card, or a credit card, and an information recording method.

2. Description of the Related Art

Information recording media recording personal identifying information such as characters as well as a personal photo-portrait image have conventionally been used as information recording media identifying a person such as a driver's license, an identification card, a passport, an ID card and credit cards.

An information recording medium as described above has generally been formed by thermal-transfer-recording thermo-melting or thermo-sublimating ink on the basis of recorded information such as characters and photos on the surface of a plastic or paper substrate. For the purpose of preventing alteration by a third party or wear of the recording portion, various security records have been made on the information recording medium. Prevention of alteration or wear of the record has been accomplished, for example, by first recording character information and a photo with the thermo-melting ink or the thermo-sublimating ink, and then, conducting lap-recording with transparent ink or lamination with a transparent film sheet on the recorded image.

The conventional information recording medium has not been suitable for preventing alteration of the record particularly the photo-portrait image.

The present invention was developed in view of these problems, and has an object to provide an information recording medium which does not permit confirmation of an image because it is colorless and transparent within the visible region, but permits confirmation of the same photo-portrait image as the photo-portrait image formed with coloring ink by irradiating ultraviolet rays or infrared rays, and an information recording method.

SUMMARY OF THE INVENTION

To achieve the aforementioned object, an information recording medium of the invention is characterized in that the same photo-portrait image as the photo-portrait image is recorded with ultraviolet ink or infrared ink which emits fluorescence by irradiation of ultraviolet rays or infrared rays on a portion different from the recording portion of the photo-portrait image with the coloring ink on the surface of the substrate.

As a result of adoption of this configuration, it is possible to confirm the same photo-portrait image as the photo-portrait image made by the use of the coloring ink on the surface of the substrate by irradiating ultraviolet rays or infrared rays, although an image cannot be confirmed within the visible region.

Another information recording medium of the invention, is characterized in that the photo-portrait image recorded with ultraviolet ink or infrared ink is an image recorded on the basis of image data made by density-reversing image data of the photo-portrait image made with the coloring ink.

As a result of adoption of this configuration, it is possible to confirm a photo-portrait image showing quite the same shape and color as those of the photo-portrait image made with the coloring ink upon irradiation of ultraviolet rays or infrared rays.

An information recording method of the invention is characterized by the step of recording the same photo-portrait image as the photo-portrait image colored with the coloring ink with ultraviolet ink or infrared ink which emits fluorescence by irradiation of ultraviolet rays or infrared rays on a portion other than the recording portion of the photo-portrait image made with the coloring ink on the surface of the substrate.

As a result of adoption of this configuration, it is possible to confirm the same photo-portrait image as the photo-portrait image made with the coloring ink on the surface of the substrate by irradiating ultraviolet rays or infrared rays, although an image cannot be confirmed because the image is colorless and transparent within the visible region.

Another information recording method of the invention, is characterized in that the photo-portrait image made with the ultraviolet ink or the infrared ink is recorded on the basis of image data prepared by density-reversing the image data of the photo-portrait image made with the coloring ink.

As a result of adoption of this configuration, it is possible to confirm a photo-portrait image showing quite the same shape and color as those of the photo-portrait image made with the coloring ink upon irradiation of ultraviolet rays or infrared rays.

DESCRIPTION OF THE PREFERRED EMBODIMENTS

Embodiments of the information recording medium of the present invention will now be described with reference to FIGS. 1 to 5.

The information recording medium 1 of the invention has a flat substrate 2 formed from paper or plastics.

For example, character information for identifying a person such as an address and a name, and a photo-portrait image 3 for personal identification are recorded with coloring ink, which is thermo-melting ink or thermo-sublimating ink, of cyan C, magenta M and yellow Y on the surface of the substrate 2.

Near the recording portion of the photo-portrait image 3 on the surface of the substrate 2, a photo-portrait image 4 showing the same shape and color as those of the photo-portrait image 3 made with the coloring ink is recorded with known ultraviolet ink or infrared ink which emits fluorescence by irradiating ultraviolet rays or infrared rays, though colorless and transparent within the visible region.

The photo-portrait image 4 made with the ultraviolet (infrared) ink is recorded with three kinds of ultraviolet (infrared) ink (re: R, green: G, and blue: B) emitting red, green and blue fluorescence upon irradiation of ultraviolet rays or infrared rays. The photo-portrait image 4 is recorded on the basis of image data prepared by density-reversing the image data of the photo-portrait image 3 made with the coloring ink. The term density-reversing as used herein means reversing only density of the image data of each of cyan C, magenta M and yellow Y without changing the image pattern, and using the resultant image data obtained by reversing only density of the individual colors as image data for red R, green G and blue B.

More specifically, the image portion made with the red R ink is recorded on the basis of the image data of the same pattern prepared by reversing only density of the image data for cyan C; the image portion made with the green G ink is recorded on the basis of the image data of the same pattern prepared by reversing only density of the image data for magenta M; and the image portion made with the blue B ink is recorded on the basis of image data of the same pattern prepared by reversing only density of the image data for yellow.

Figure 1:
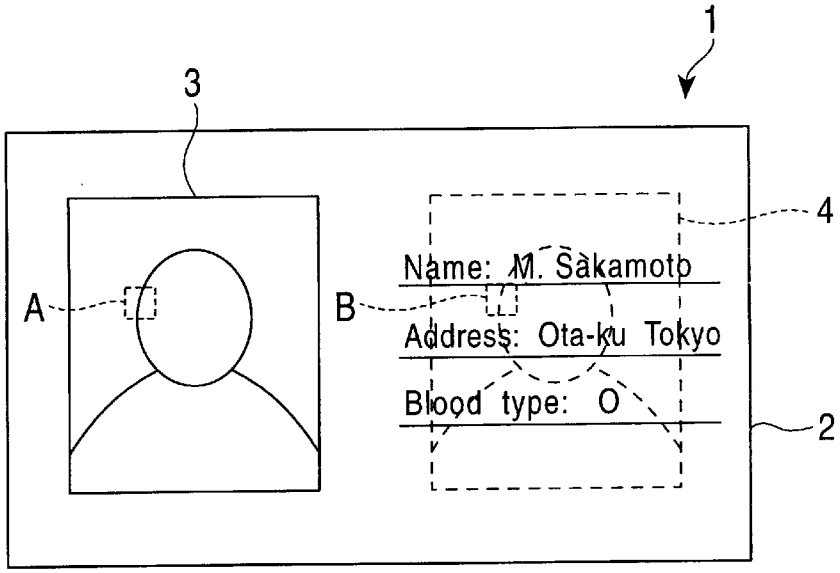
FIG. 1 illustrates an embodiment of the information recording medium of the present invention.
Figure 2:
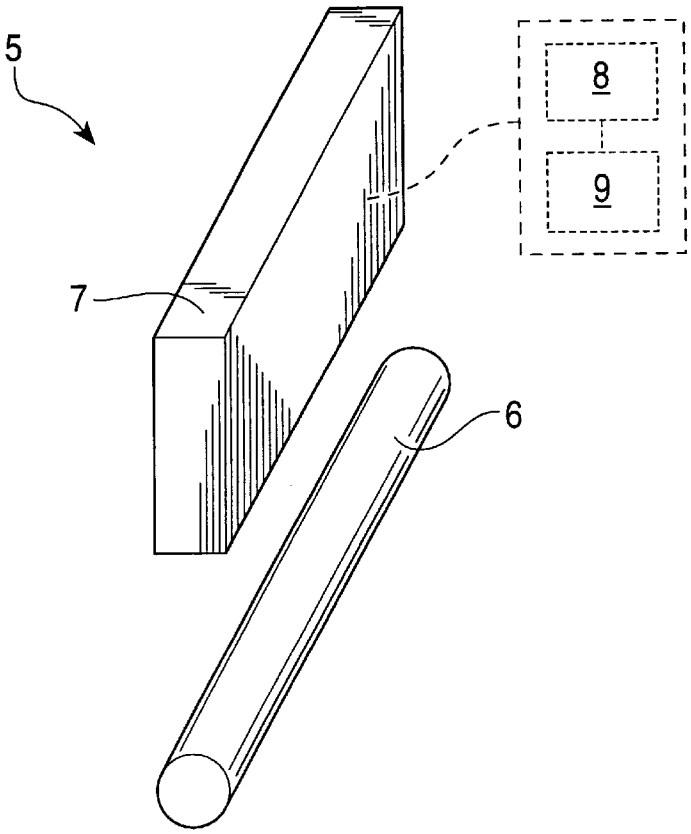
FIG. 2 illustrates a thermal transfer printer as an example of the recording apparatus recording the information recording medium in an embodiment of the information recording medium of the invention.

For example, on the assumption that a colored image within an area drawn by a broken line A in FIG. 1 is recorded with cyan C having a density of 9 (10 on the maximum; this applies also hereafter), magenta M having a density 4, and yellow Y having a density of 3, an ultraviolet (infrared) ink image recorded on the basis of image data prepared by density-reversing this coloring ink image becomes an image within the area drawn by a broken line B in the drawing having the same pattern as in the coloring ink image. The ultraviolet (infrared) ink image within this broken line B would be recorded with ultraviolet (infrared) ink of red R having a density of 1 obtained by density reversing cyan C (density: 9), ultraviolet (infrared) ink of green G having a density of 6 obtained by density-reversing magenta M (density: 4), and ultraviolet (infrared) ink of blue B having a density of 7 obtained by density-reversing yellow Y (density: 3).

The ultraviolet ink and the infrared ink, being colorless and transparent within the visible region, never exert an effect on recording of the coloring ink. The photo-portrait image 4 may therefore be recorded by superposing the same on the recording portion of, for example, the aforementioned character information. However, in order to permit collation of the photo-portrait image 3 made with the coloring ink with the photo-portrait image 4 made with the ultraviolet (infrared) ink upon irradiation of ultraviolet (infrared) rays, the photo-portrait image 4 made with the ultraviolet (infrared) ink should preferably be recorded on a portion other than the recording portion of the photo-portrait image 3 made with the coloring ink.

A thermal transfer printer 5 (shown in FIG. 2) will now be described as an example of the recording apparatus recording the information recording medium 1 in this embodiment.

The thermal transfer printer 5 has a long platen roller 6 supported rotatably in the transfer direction of the substrate 2 at a desired position on a frame (not shown). A thermal head 7 comprising a plurality of heating elements formed thereon is arranged so as to be in contact with the outer peripheral surface of the platen roller 6.

The thermal transfer printer 5 has a memory 8 for storing the image data of the photo-portrait image 3 upon recording the photo-portrait image 3 made with the coloring ink.

Further, the aforementioned thermal transfer printer 5 has an image data control section 9 for reading out the image data of the photo-portrait image 3 made with the coloring ink stored in the memory 8, and converting the read-out image data into image data for the photo-portrait image 4 made with the ultraviolet (infrared) ink by density-reversing the read-out image data.

An embodiment of the information recording method of the invention will now be described as a recording method of the aforementioned information recording medium 1.

Figure 3:
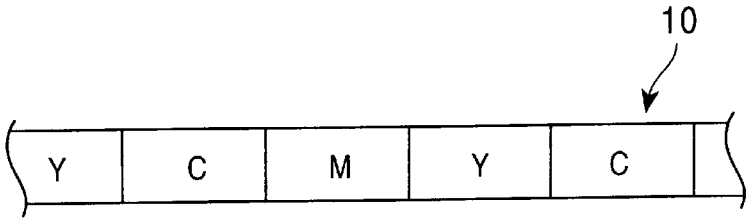
FIG. 3 illustrates a coloring ink ribbon in an embodiment of the information recording method of the invention.
Figure 4:
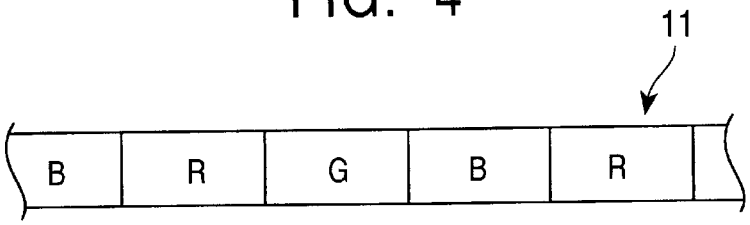
FIG. 4 illustrates an ultraviolet (infrared) ink ribbon in an embodiment of the information recording method of the invention.

In the information recording method in this embodiment, there is used a coloring ink ribbon 10 (as shown in FIG. 3) in which cyan C, magenta M and yellow Y ink layers are formed continuously in the longitudinal direction on a long resin film, as an ink ribbon used for recording with the coloring ink. An ultraviolet (infrared) ink ribbon (as shown in FIG. 4) in which red R, green G and blue B ultraviolet (infrared) ink layers are continuously formed in the longitudinal direction on a resin film is employed as an ink ribbon used for recording with the ultraviolet (infrared) ink.

Figure 5:
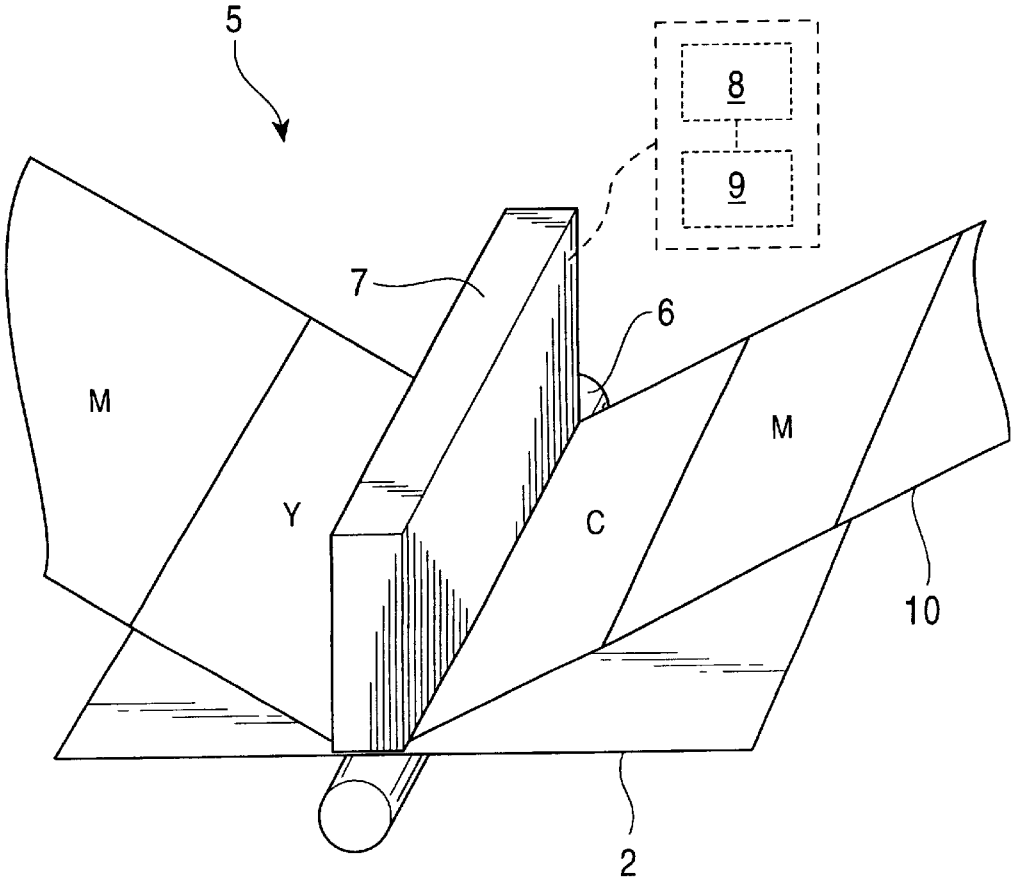
FIG. 5 illustrates a state of image recording by a thermal transfer printer in an embodiment of the information recording method of the invention.

In this embodiment, after first transferring the substrate 2 onto the platen roller 6, the thermal head 7 is brought into pressure-contact with the surface of the substrate 2 via the coloring ink ribbon 10 as shown in FIG. 5.

Character information and the photo-portrait image 3 based on the cyan C, magenta M and yellow Y coloring ink are formed on the surface of the substrate 2 by selectively causing heat generation of the heating elements of the thermal head 7 in accordance with the recording information for recording character information such as an address and a name and a photo-portrait image 3 of a person, while coiling the ink ribbon during transfer of the substrate 2 in the transverse direction in FIG. 5.

At this point, the memory 8 stores the image data of the photo-portrait image 3 made with the coloring ink.

When recording the photo-portrait image 4 made with the ultraviolet (infrared) ink on the substrate 2 having the character information and the photo-portrait image 3 made with the coloring ink recorded thereon, the recording portion of the substrate 2 is first transferred to a space between the platen roller 6 and the thermal head 7, and the thermal head 7 is brought into pressure-contact with the surface of the recording portion of the substrate 2 via the ultraviolet (infrared) ink ribbon 11 in the same manner as that shown in FIG. 5.

The image data of the photo-portrait image 3 made with a coloring ink are read in from the memory 8 by the image data controlling section 9, and the image data are concentration-reversed into image data for red R, green G and blue B. More specifically, the image data for cyan C are density-reversed into image data for red R which is a complementary color of cyan C; the image data for magenta M are density-reversed into image data for green G which is a complementary color of magenta M; and the image data for yellow Y are density-reversed into image data for blue B which is a complementary color of yellow Y.

The photo-portrait image 4 having the same pattern as in the photo-portrait image 3 made with the coloring ink is recorded on the substrate 2 with red r, green G and blue B ultraviolet (infrared) ink on the basis of the image data of red R, green G and blue B. As a result, there is completed the information recording medium 1 having the character information and the photo-portrait image 3 made with the coloring ink, as well as the photo-portrait image 4 made with the ultraviolet (infrared) ink, recorded on the substrate 2.

Because the ultraviolet (infrared) ink is colorless and transparent within the visible region, the photo-portrait image 4 made with the ultraviolet (infrared) ink cannot be confirmed during usual carrying of the information recording medium 1. However, since the ultraviolet (infrared) ink emits fluorescence composed of the three primary colors of light of red r, green G and blue B upon irradiation of ultraviolet (infrared) rays, it is possible to confirm the photo-portrait image 4 made with the ultraviolet (infrared) ink showing the same shape and color as in the photo-portrait image 3 made with the coloring ink by irradiating ultraviolet (infrared) rays onto the surface of the information recording medium 1.

According to this embodiment, therefore, alternation of the photo-portrait image 3, if any, can easily be detected by collating with the photo-portrait 4 made with the ultraviolet (infrared) ink, even when the photo-portrait image 3 made with the coloring ink is altered.

The present invention is not limited to the embodiments shown above, but it is possible to make various modifications as required.

For example, when the photo-portrait image 3 made with the coloring ink is colorless, and a portion thick in black of the coloring ink image 3 is directly used as the portion thick in black of the ultraviolet (infrared) ink image 4, it is difficult to confirm the image because the black portion of the ultraviolet (infrared) ink image 4 hardly reflects the light. When the photo-portrait image 3 made with the coloring ink is colorless, therefore, it suffices to apply monochromatic conversion for converting the black portion of the coloring ink image 3 into a white portion of the ultraviolet (infrared) ink image 4 to the image data of the coloring ink, and further density-reversing the image data subjected to monochromatic conversion into image data for the ultraviolet (infrared) ink. In this case, the thick black portion of the color ink image 3 can become a portion of an image clearly discernible by strongly reflecting the thick white portion of the ultraviolet (infrared) ink image 4, i.e., ultraviolet (infrared) rays.

According to the information recording medium of the invention and the other information recording method of the invention, as described above, it is possible to easily confirm an alternation, if any, of a photo-portrait image.

According to the information recording medium and the information recording method of the invention, a photo-portrait image showing quite the same shape and color as the photo-portrait image of the coloring ink is recorded, so that it is possible to detect a subtle alternation of the photo-portrait image, in addition to the advantages described above.

What is claimed is:

1. An information recording medium recording personal identifying information such as characters as well as a photo-portrait image for personal identification on the surface of a substrate, comprising:

a coloring ink image recording said photo-portrait image made with coloring ink that is visible under visible light, the recording on a portion of the surface of the substrate, and an ultraviolet ink image or an infrared ink image recording a photo-portrait image of the same pattern as that of said coloring ink image, with ultraviolet ink that is colorless and transparent under visible light or infrared ink that is colorless and transparent under visible light, the ultraviolet ink or infrared ink emitting fluorescence by irradiation of ultraviolet rays or infrared rays on a portion of the surface of the substrate other than the recording portion of said coloring ink image.

2. An information recording medium according to claim 1, wherein said ultraviolet ink image or infrared ink image is recorded on the basis of image data in a complementary color relationship with the image data obtained by density-reversing the image data of said coloring ink image.

3. An information recording medium according to claim 1, wherein said information recording medium is a driver's license.

4. An information recording medium according to claim 1, wherein said information recording medium is an identification card.

5. An information recording medium according to claim 1, wherein said information recording medium is a passport.

6. An information recording medium according to claim 1, wherein said information recording medium is a credit card.

7. An information recording medium recording personal identifying information such as characters as well as a color photo-portrait for personal identification recorded by the use of cyan, magenta, and yellow coloring ink visible under visible light on the surface of a substrate, wherein:

a photo-portrait image of the same pattern as said photo-portrait is recorded by the use of an ultraviolet-ray ink or an infrared ink of red, green, and blue which are colorless and transparent within the visible light region, but emit fluorescence by irradiation of ultraviolet rays or infrared rays on a portion of the substrate other than the recording portion of said photo-portrait image recorded with said coloring ink on the same surface of said substrate, and said photo-portrait image recorded with said ultraviolet ink or infrared ink is an image recorded with said ultraviolet ink or infrared ink of red, green, and blue by the use of image data in the complementary color relationship with the image data obtained by reversing only density of the image data of the photo-portrait image made with said coloring ink.

8. An information recording medium according to claim 7, wherein said information recording medium is a driver's license.

9. An information recording medium according to claim 7, wherein said information recording medium is an identification card.

10. An information recording medium according to claim 7, wherein said information recording medium is a passport.

11. An information recording medium according to claim 7, wherein said information recording medium is a credit card.

12. An information recording apparatus for recording personal identifying information such as characters and a photo-portrait image for personal identification on a substrate by the use of coloring ink visible under visible light on a personal identifying information recording medium, and for recording a photo-image portrait of the same pattern as said photo-portrait by the use of ultraviolet-ray ink or infrared-ray ink which is colorless and transparent within the visible light region, but emits fluorescence under irradiation of ultraviolet or infrared rays, on a portion of the substrate other than the portion on which said photo-portrait image is recorded, comprising:

an image data memory storing image data of said photo-portrait recorded with the coloring ink; and an image data controller which reads in the image data of said photo-portrait image from said image data memory, reverses only density of said image without changing the image pattern of said image data, and converts said image data into an image data in a complementary color relationship therewith, wherein:

a photo-portrait image of the same pattern as said photo-portrait image recorded with said coloring ink is recorded by the use of ultraviolet-ray ink or infrared-ray ink which is colorless and transparent within the visible light region but emits fluorescence under irradiation of ultraviolet or infrared rays, on a portion of the substrate other than the recording portion of said photo-portrait image on the same surface of the substrate as that recording the personal identifying information such as characters and a photo-portrait image for personal identification on said information recording medium, on the basis of said image data converted by said image data controller.

13. An information recording apparatus according to claim 12, wherein:

said coloring ink comprises cyan, magenta, and yellow colors;

said image data memory stores the image data of the recorded photo-portrait image as image data of these colors including cyan, magenta, and yellow;

said image data controller reads in image data of said individual colors of said image data memory, reverses only density of the individual image data without changing the image pattern; and converts the resultant image data into image data in a complementary relationship with the individual image data of which only density has been reversed;

the photo-portrait image of the same pattern as said photo-portrait recorded with said coloring ink is recorded by the use of ultraviolet-ray ink or infrared-ray ink of red, green, and blue which are colorless and transparent within the visible light region but emit fluorescence under irradiation of ultraviolet rays or infrared rays, on a portion of the substrate other than the recording portion of said photo-portrait image on the same surface as the surface recording said personal identifying information such as characters and personal identifying photo-portrait on said information recording medium, on the basis of said individual converted image data.

14. A method of detecting alteration of an image, comprising the steps of:

recording an image with coloring ink visible under visible light on a substrate;

recording the same image with ultraviolet-ray ink or infrared-ray ink invisible under visible light on a different portion of the same substrate; and periodically comparing the image recorded with coloring ink to the image recorded with ultraviolet-ray ink or infrared-ray ink.

15. The method of claim 14 wherein the recording with ultraviolet-ray ink or infrared-ray ink uses colors complementary to the colors used in the recording with coloring ink.

* * * * *